United States Patent [19]

Duckman et al.

[11] Patent Number: 4,630,564

[45] Date of Patent: Dec. 23, 1986

[54] BOOM CONTROL DEVICE FOR A SAILBOAT BOOM

[76] Inventors: Donald Duckman, Brunnsgatan 9; Curt Duckman, Oslovägen 41, both of 452 00 Strömstad; Kjell Andrén, Dr Südows gata 28, 431 24 Göteborg, all of Sweden

[21] Appl. No.: 778,754

[22] PCT Filed: Apr. 21, 1983

[86] PCT No.: PCT/SE83/00150

§ 371 Date: Dec. 22, 1983

§ 102(e) Date: Dec. 22, 1983

[87] PCT Pub. No.: WO83/03806

PCT Pub. Date: Nov. 10, 1983

Related U.S. Application Data

[63] Continuation of Ser. No. 571,546, Dec. 22, 1983, abandoned.

[30] Foreign Application Priority Data

Apr. 23, 1982 [SE] Sweden ..... 8202555

[51] Int. Cl.[4] ..... B63H 9/10

[52] U.S. Cl. ..... 114/98; 114/99

[58] Field of Search ..... 114/39, 89, 90, 97, 114/98, 99, 102, 109, 111–115; 212/153

[56] References Cited

U.S. PATENT DOCUMENTS

| | | | |
|---|---|---|---|
| 3,090,340 | 5/1963 | McCutchen et al. | 114/102 |
| 3,310,017 | 3/1967 | Dyer | 114/98 |
| 3,918,037 | 11/1975 | Hall | 212/153 |
| 4,114,551 | 9/1978 | Hall | 114/98 |
| 4,138,962 | 2/1979 | Waelder | 114/102 |
| 4,367,688 | 1/1983 | Godfrey | 114/39 |
| 4,406,240 | 9/1983 | Andersen | 114/102 |

FOREIGN PATENT DOCUMENTS

| | | | |
|---|---|---|---|
| 422186 | 2/1982 | Sweden | 114/102 |

*Primary Examiner*—Trygve M. Blix
*Assistant Examiner*—Stephen P. Avila

[57] ABSTRACT

Arrangement for a boat (1) which has a boom projecting out from a mast (2) and designed to be connected to a sail, especially on a sailing boat (1). The invention enables the boom to be prevented effectively and reliably from swinging around the mast too rapidly on occasions when this is not desired, and thus reduces the risk of personally injury occasioned by the boom. The arrangement (5) is connected via one section (5A) to the boat (1) and is connected via a further section (5B) to the boom (3), the two said sections (5A and 5B respectively) being mutually connected in such a way that the arrangement (5) forcibly urges the boom (3) to swing towards a position substantially transverse to the boat (1).

6 Claims, 4 Drawing Figures

BOOM CONTROL DEVICE FOR A SAILBOAT BOOM

This application is a continuation of application Ser. No. 571,546, filed Dec. 22, 1983, now abandoned.

The present invention relates to a boom arrangement which is designed to be used on a boat which has a boom projecting out from a mast and designed to be connected to a sail, especially on a sailing boat.

The main object of the present invention is primarily to provide an arrangement of the above-mentioned kind which effectively and reliably prevents the boom from swinging around the mast too rapidly on occasions when this is not desired, and thus to reduce the risk of personal injury occasioned by the boom.

The said object is achieved by an arrangement according to the present invention, the characteristics of which may be found in the patent claims.

Figure 4:
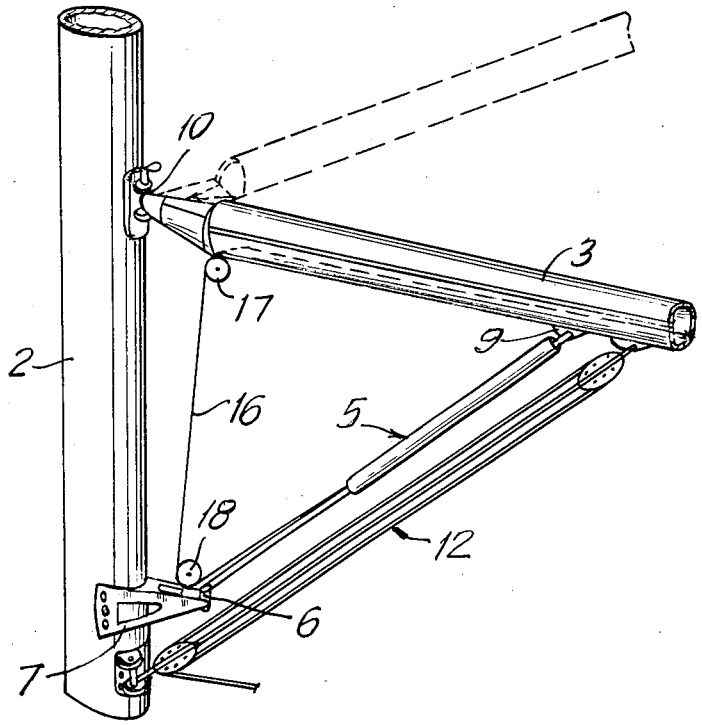
Figure 1:
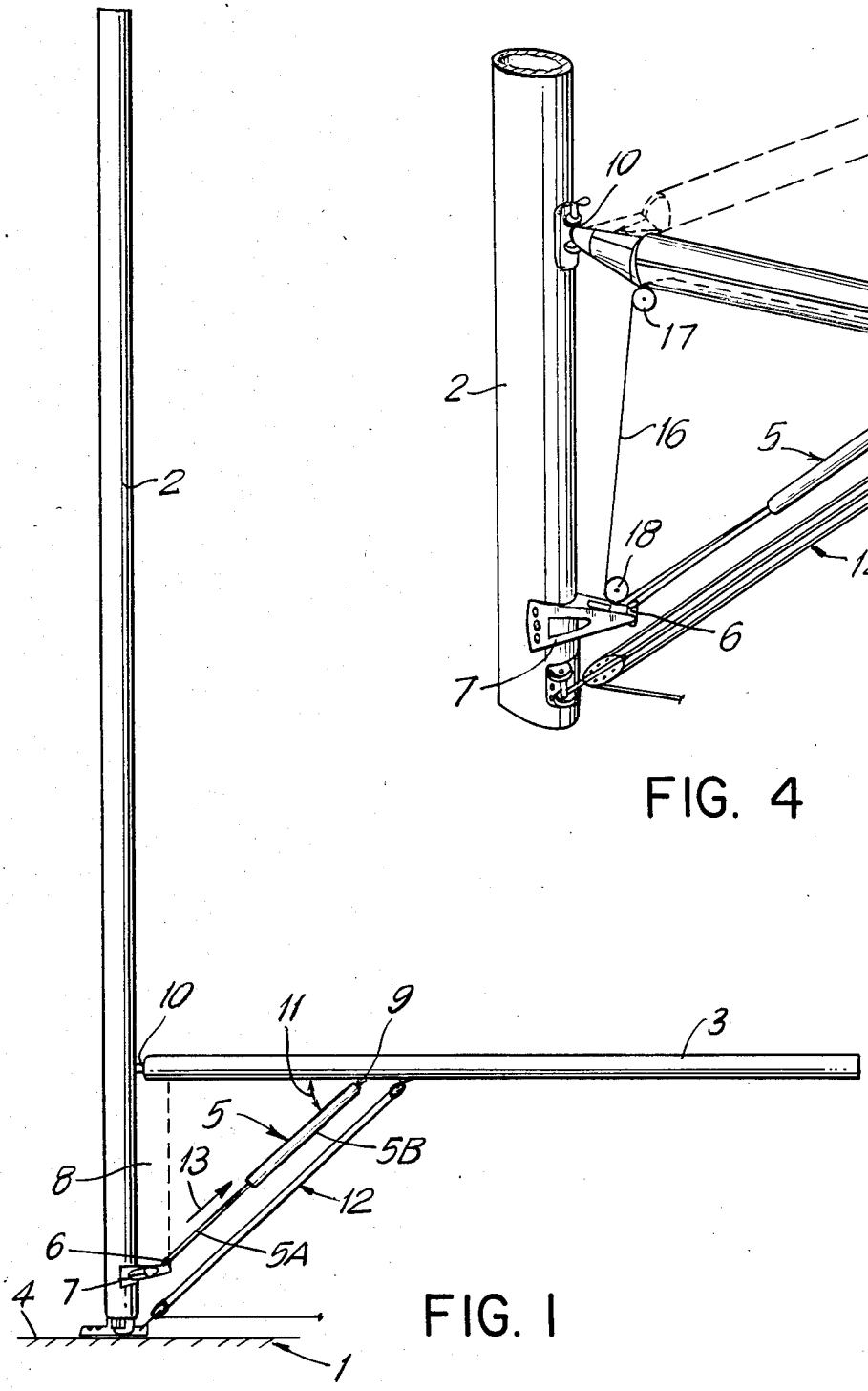
Figure 2:
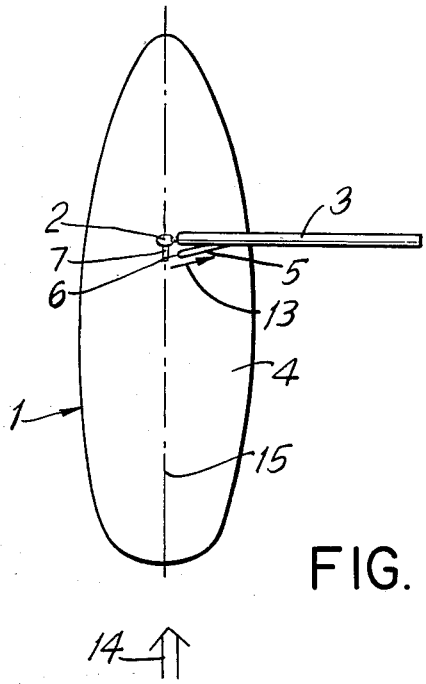
Figure 3:
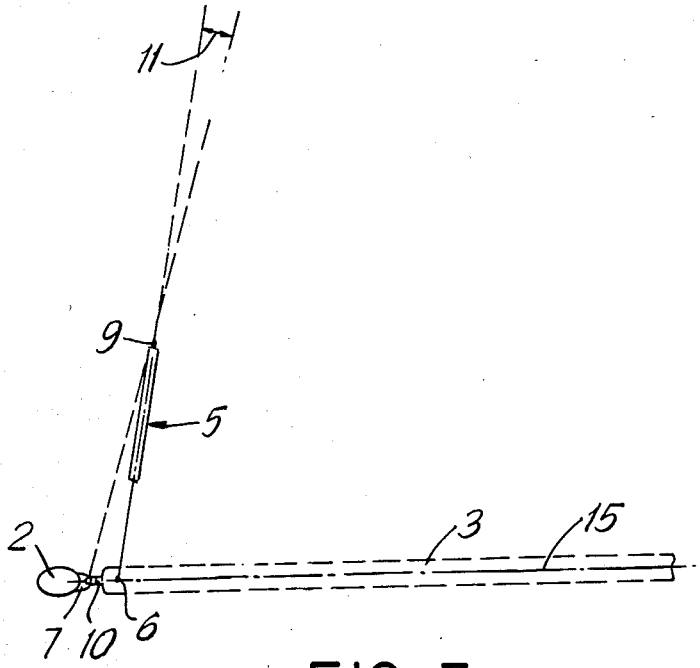

The invention is described in the following by way of an embodiment example, with reference to the accompanying drawings, on which FIG. 1 shows a schematic side view of a sailing boat with the mast and boom appertaining thereto, with a boom arrangement according to the invention connected to the boom and held in an intermediate position with the boom brought into a plane extending in the longitudinal direction of the boat, FIG. 2 is a schematic plan view of the sailing boat with the boom swung out into a maximum sailing position, FIG. 3 is a schematic plan view of the boat with the arrangement held in a position in which it prevents the boom from swinging backwards too rapidly, and FIG. 4 is a perspective view of a mast with the pivotable boom appertaining to it, with a boom arrangement designed according to the invention acting on the boom, and with a stern rope connected to the said boom arrangement.

On the drawings the sailing boat is designated with the numeral 1, while a mast and the boom appertaining thereto are designated with the mumerals 2 and 3 respectively. A boom arrangement 5 according to the invention is designed to extend between the boom 3 and the mast 2 or between the boom 3 and the deck 4 of the sailing boat 1, for example. As shown in the present embodiment, the said boom arrangement 5 may consist of a telescopic piston 5 which operates with a spring effect.

The piston 5 is turnably connected at one of its ends, 5A, to the mast 2 or the deck 4 via a mounting 6. The said mounting 6 may be supported on a bracket 7 extending out from the mast 2 so that the mounting 6 is located at a specific distance 8 from the mast 2 in the region behind a plane which extends transversely across the boat 1 through the mast 2.

The opposite end 5B of the piston is connected rotatably via a joint 9 to the boom 3, some way from the boom mounting 10 acting between the mast 2 and the boom 3, so that an angle 11 is formed between the arrangement 5 and the boom 3.

Optionally, a kick 12 is provided, disposed at a distance from the piston 5, and behind the latter, viewed in the longitudinal direction of the boat.

The boom arrangement 5 is constructed so that it strives to extend itself, i.e. so that it urges the boom 3 with a certain force in the direction away from the fixing point 6 on the mast 2 or the deck 4 for the arrangement, as shown with the arrow 13.

The arrangement 5 may consist of a pneumatic spring of a known kind or the like, or it may be designed to act by means of a mechanical spring element.

The arrangement 5 operates so that when the boat is being sailed with the wind direction 14 coinciding with the longitudinal direction 15 of the boat, straight from astern, i.e. what is known as running before the wind, as shown in FIG. 2, the arrangement 5 urges the boom 3 in the direction of the arrow 13 as shown in FIG. 2. If the wind veers suddenly and if the boat is being sailed in rough seas with large waves, for example, the boom 3 normally strives to swing rapidly around the mast 2 and the mounting 10, in over the boat deck 4. The crew and passengers thereby risk being hit by the boom on the head, resulting in serious injury. The arrangement 5 prevents the boom 3 from swinging round too rapidly on these occasions, as described above, and the crewman who is sometimes detailed to stand by the mast and prevent the said undesired swinging of the boom 3 may be put to more effective use, carrying out the normal tasks of the crew on board, especially during competitive sailing.

The arrangement 5 operates even when the boat is reaching or sailing free, without obstructing the normal movements of the boom.

Preferably, the force which acts in the direction of the arrow 13 is strongest when the boom 3 is swung out furthest from the boat 1, and decreases progressively as the boom is swung in over the boat 1, due to the construction of the arrangement.

In order to warn the crew and passengers that the boom 3 is swinging in towards the boat deck 4, the arrangement may be equipped with a gas outlet or some other suitable device which produces noise and/or light signals when the boom 3 is swinging. The said device may be designed, for example, to let gas escape from inside the arrangement, thereby producing a whistling signal. Preferably, it will be possible to disconnect the said device manually when it is not required to operate, for example, when beating.

The arrangement 5 also operates as a boom holding device when the boom 3 is brought into a position extending along the centre line 15 of the boat.

A further effect which is obtained by means of the arrangement 5 is that the boom 3 strives to rise up in the direction away from the boat deck 4 in a curve which displays greater height in the region above the deck 4 than when the boom 3 is held in a swung-out position. The said effect enables the so-called automatic regulating of the shape of the sail to take place, so that the sail is endowed with a maximum wind receiving form, i.e. it billows out.

The benefits gained by means of the invention with regard to sailing are that the arrangement 5 moves the boom 3 rapidly out into the wind, that it holds the boom 3 out when running, that it makes it possible to sail on a so-called "wrong tack" when running free—which automatically allows the Genoa and the foresail to fill, that it can replace the Dirk and thereby keep the boom 3 away from the cockpit when moored up, and that the boom is locked by the effect of the arrangement when motoring.

With regard to the question of safety, the said boom arrangement makes it possible to prevent sudden violent gybes, it prevents the boom from breaking when it swings, the boom is held up when reefing, the boom is locked with the aid of the main sheet in all lateral positions and with the aid of the kicking strap in the vertical direction, and it replaces a Preventer rope.

FIG. 4 shows how a stern rope 16 which is accommodated inside the boom, for example, is deflected via a block 17 or 18 respectively, located on the boom 3 or on the bracket 7 respectively, so that it extends in the direction of the said boom arrangement 5 and is connected to a part thereof. The halyard on the boat may also be deflected round the block 18 which is mounted on the bracket 7, and attached to the arrangement 5. When the boom 3 swings out, the stern rope shown on the drawing is made to extend, compared with when the boom 3 is pointing straight astern, so that the sail is thereby endowed with a greater billow which is desirable when the boom 3 is swung out to the side. Effective automatic adjustment of the rope and/or halyard is therefore also made possible by means of the present invention.

The invention is not limited to the embodiment example shown on the drawings and described above, but its details may be modified within the framework of the following patent claims.

We claim:

1. A boom control device for a sail boat having a mast, a mounting projecting from the mast, and a boom pivotally connected to said mounting and to be connected to a sail; said boom control device comprising: a unit having two sections, a first pivot directly connecting one section to said boat rearwardly of said mounting as viewed in the longitudinal direction of the boat to be spaced from said boom rearwardly of said boat, and a second pivot directly connecting the other section to said boom, said two sections forming a spring element such that the device urges the boom to swing out transversely across the boat from the longitudinal direction thereof and resists swinging back to the longitudinal direction, said device extending at a first angle in a vertical plane with respect to said boom and at a second angle in a horizontal plane when swung out across the boat, said spacing and angles being set so that urging force exerted on said boom by said spring element is maximum when the boom is oriented transversely of the longitudinal centerline of the boat and decreases to a minimum when the boom is oriented to extend along the longitudinal centerline of the boat.

2. A device according to claim 1, wherein said two sections exert the greatest force on the boom when the same is swung out transversely furthest from the boat and wherein the force decreases progressively as the boom swings towards the longitudinal direction of the boat.

3. The device according to claim 2, wherein the connection of the device to the boat and the boom is such that the boom will rise away from the deck of the boat when moving towards the longitudinal direction of the boat in comparison to when the boom is located transverse to the longtudinal direction.

4. The device according to claim 1, wherein said unit is a piston and cylinder unit.

5. The device according to claim 1, comprising a bracket mounting said first pivot at a distance from said mast.

6. The device according to claim 1, wherein said spring element is a pneumatic spring.

* * * * *